US011075025B2

(12) United States Patent
Blomqvist et al.

(10) Patent No.: US 11,075,025 B2
(45) Date of Patent: Jul. 27, 2021

(54) APPARATUS, SYSTEM AND METHOD FOR ELECTRICAL CONNECTION

(71) Applicant: Nokia Technologies Oy, Espoo (FI)

(72) Inventors: Kim Blomqvist, Espoo (FI); Harri Lasarov, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/954,953

(22) PCT Filed: Nov. 30, 2018

(86) PCT No.: PCT/EP2018/083136
§ 371 (c)(1),
(2) Date: Jun. 17, 2020

(87) PCT Pub. No.: WO2019/120939
PCT Pub. Date: Jun. 27, 2019

(65) Prior Publication Data

US 2020/0335245 A1 Oct. 22, 2020

(30) Foreign Application Priority Data

Dec. 22, 2017 (EP) ..... 17210210

(51) Int. Cl.
*H01C 1/14* (2006.01)
*H01C 1/148* (2006.01)
(Continued)

(52) U.S. Cl.
CPC ..... *H01C 1/148* (2013.01); *H01C 7/13* (2013.01); *H01C 17/0652* (2013.01); *H01R 13/03* (2013.01)

(58) Field of Classification Search
CPC ..... H01C 1/148; H01C 7/13; H01C 17/0652; H01R 13/03
(Continued)

(56) References Cited

U.S. PATENT DOCUMENTS 3,881,162 A * 4/1975 Caddock ..... H01C 17/245 338/61
4,470,034 A * 9/1984 Lopacki ..... H01C 1/06 29/621
(Continued)

FOREIGN PATENT DOCUMENTS

DE 4342899 C1 6/1995
DE 102007042174 A1 3/2009
(Continued)

OTHER PUBLICATIONS

"TFS Series, Surge Capable Thick Film Non Inductive", Ohmite, Retrieved on Jun. 17, 2020, Webpage available at : https://www.mouser.com/datasheet/2/303/res_tfs-1265402.pdf.
(Continued)

*Primary Examiner* — Edwin A. Leon
*Assistant Examiner* — Iman Malakooti
(74) *Attorney, Agent, or Firm* — Nokia Technologies Oy

(57) ABSTRACT

An apparatus comprising: a connector configured to be electrically and mechanically connectable to an electrical terminal, wherein the connector comprises a resistive material. The connector comprises respective first and second electrical contacts, wherein the resistive material is configured to provide a direct current connection for the flow of electric current between the first and second electrical contacts.

15 Claims, 8 Drawing Sheets

(51) Int. Cl.
*H01C 7/13* (2006.01)
*H01C 17/065* (2006.01)
*H01R 13/03* (2006.01)

(58) Field of Classification Search
USPC ..... 338/332
See application file for complete search history.

(56) References Cited

U.S. PATENT DOCUMENTS

| | | | | |
|---|---|---|---|---|
| 5,792,185 | A | 8/1998 | Burton et al. | |
| 5,850,920 | A * | 12/1998 | Gilman | A61N 1/046 206/701 |
| 6,539,613 | B1 | 4/2003 | Ulmer | |
| 6,935,879 | B2 | 8/2005 | Whitney et al. | |
| 8,493,749 | B2 | 7/2013 | Myers et al. | |
| 8,987,864 | B2 * | 3/2015 | Kim, II | H01C 1/01 257/536 |
| 9,396,849 | B1 * | 7/2016 | Wyatt | H01C 17/28 |

FOREIGN PATENT DOCUMENTS

| | | | |
|---|---|---|---|
| FR | 2251111 | A1 | 6/1975 |
| GB | 596436 | A | 1/1948 |
| WO | 2016/134473 | A1 | 9/2016 |

OTHER PUBLICATIONS

"Ceramic Injection Moulding Process—Morgan Advanced Materials", Youtube, Retrieved on Jun. 17, 2020, Webpage available at : https://www.youtube.com/watch?v=0hl7wVDa9Ww.

"Component Reliability is Key for Medical Electronics", Electronics weekly.com, Retrieved on Jun. 17, 2020, Webpage available at : https://www.electronicsweekly.com/news/products/passives/component-reliability-is-key-for-medical-electronics-2011-11/.

Chen et al., "A Low-power Bio-potential Acquisition System with Flexible PDMS Dry Electrodes for Portable Ubiquitous Healthcare Applications", Sensors, vol. 13, 2013, pp. 3077-3091.

Extended European Search Report received for corresponding European Patent Application No. 17210210.5, dated Jun. 19, 2018, 8 pages.

International Search Report and Written Opinion received for corresponding Patent Cooperation Treaty Application No. PCT/EP2018/083136, dated Feb. 14, 2019, 12 pages.

"Electically Conductive Plastic in Injection molding applications", Premix Group, Retrieved on Jul. 8, 2020, Webpage available at : http://www.premixgroup.com/electrically-conductive-plastics-in-injection-molding-applications/.

* cited by examiner

APPARATUS, SYSTEM AND METHOD FOR ELECTRICAL CONNECTION

RELATED APPLICATION

This application claims priority to PCT Application No. PCT/EP2018/083136, filed on Nov. 30, 2018, which claims priority to European Application No. 17210210.5, filed on Dec. 22, 2017, each of which is incorporated herein by reference in its entirety.

TECHNOLOGICAL FIELD

Examples of the disclosure relate to an apparatus, system and method for electrical connection, and in particular electrical connections for protecting an electronic device, such as a wearable device, from an electrical power surge.

BACKGROUND

Electrical power surges can damage electronic devices.

There is a requirement to provide means of protecting electronic devices from such electrical power surges. In particular, there is a requirement to provide such means for wearable devices, such as wearable devices configured to measure a body function of a subject, such as a health parameter.

BRIEF SUMMARY

According to various, but not necessarily all, examples of the disclosure there is provided an apparatus comprising: a connector configured to be electrically and mechanically connectable to an electrical terminal, wherein the connector comprises a resistive material, wherein the connector comprises respective first and second electrical contacts, wherein the resistive material is configured to provide a direct current connection for the flow of electric current between the first and second electrical contacts.

The connector may comprise a snap connector.

The first and second electrical contacts may be separated by an insulating material. The insulating material may be arranged to guide the flow of electric current between the first and second electrical contacts through the resistive material.

In some examples, the connector may comprise a body, the body comprising the insulating material, wherein a layer of the resistive material is provided on at least a part of the external surface of the body, the insulating material being arranged to guide the flow of electric current between the first and second electrical contacts through the resistive material.

The body may be formed of the insulating material. The insulating material may be a ceramic material. The ceramic material may be alumina.

The layer of resistive material may comprise a metallic layer. The layer of resistive material may be a thin film resistor. Alternatively, the layer of resistive material may be a thick film resistor.

The connector may comprise an opening extending part way into the body, wherein a first of the electrical contacts is provided in the opening, and a second of the electrical contacts is provided on an opposite side of the connector to the opening. The connector may comprise a protective coating overlaying at least a part of the external surface.

In other examples, the connector may comprise a body, the body comprising the resistive material. The body may comprise a conductive shell, wherein a layer of the insulating material is provided between at least a part of the conductive shell and the resistive material. A first of the electrical contacts may be provided by the conductive shell, and a second of the electrical contact extends from the resistive material, the layer of insulating material being arranged to guide the flow of electric current between the first and second electrical contacts through the resistive material. The conductive shell may comprise metal. The resistive material may comprise carbon composition.

In other examples, the connector may comprise a body, the body comprising the resistive material. The body may be formed of the resistive material. The resistive material may comprise conductive plastic. The conductive plastic may comprise an electrically conductive filler. The conductive plastic may comprise carbon black.

The connector may comprise a formation shaped to mate with a corresponding formation on an electrode to electrically and mechanically connect to the electrode.

According to various, but not necessarily all, examples of the disclosure there is provided a system, the system comprising an electronic device, the electronic device comprising the apparatus according to any of the preceding paragraphs.

A first side of the connector may be joined to the electronic device, and a second side of the connector comprises a formation shaped to mate with a corresponding formation on an electrode to electrically and mechanically connect to the electrode.

The connector may comprise a snap connector.

The electronic device may be configured to monitor a health parameter in a subject.

The electrode may be configured to be engageable with the subject to make an electrical circuit with the electronic device to allow detection of the health parameter.

According to various, but not necessarily all, examples of the disclosure there is provided a method, the method comprising:

providing an apparatus, the apparatus comprising a connector, the connector comprising a resistive material;

configuring the connector to be electrically and mechanically connectable to an electrical terminal;

configuring the resistive material to provide a direct current connection for the flow of electric current between a first and a second electrical contact of the connector.

According to various, but not necessarily all, examples of the disclosure there is provided a method for protecting an electronic device from a power surge, the method comprising:

monitoring a health parameter of a subject with an electronic device comprising an apparatus according to any of the preceding claims;

the apparatus dissipating electrical energy from a power surge to protect the electronic device.

The electronic device may be a wearable electronic device.

The health parameter may be the electrical activity of the heart.

According to various, but not necessarily all, examples of the disclosure there may be provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

The figures illustrate an apparatus 10 comprising: a connector 12 configured to be electrically and mechanically connectable to an electrical terminal, wherein the connector 12 comprises a resistive material 14. The connector 12 comprises respective first and second electrical contacts 16, 18. The resistive material 14 is configured to provide a direct current connection for the flow of electric current between the first and second electrical contacts 16, 18.

The direct current connection comprises a galvanic connection between the first and second electrical contacts 16, 18. It is to be appreciated that both alternating current signals and direct current signals can be transmitted via the direct current path.

The connector 12 may be connectable to an electrical terminal by a friction fit, which may be an interference fit.

Figure 1:
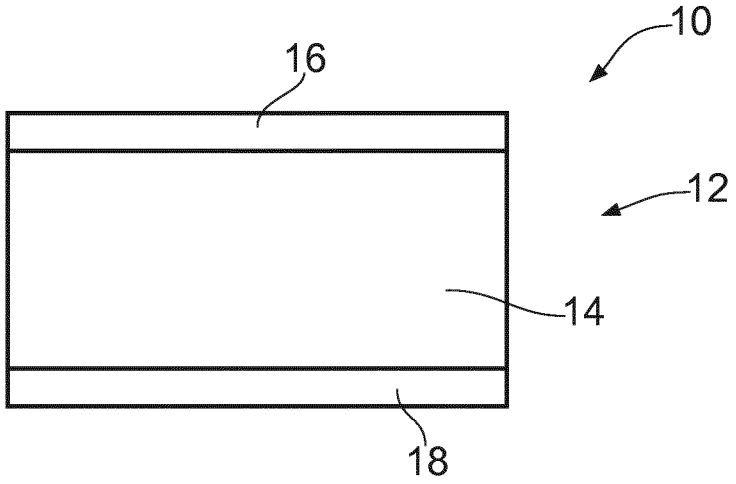
FIG. 1 illustrates an example apparatus.

FIG. 1 illustrates an apparatus 10 comprising: a connector 12 configured to be electrically and mechanically connectable to an electrical terminal, wherein the connector 12 comprises a resistive material 14. The connector 12 comprises respective first and second electrical contacts 16, 18. The resistive material 14 is configured to provide a direct current connection for the flow of electric current between the first and second electrical contacts 16, 18.

Figure 2:
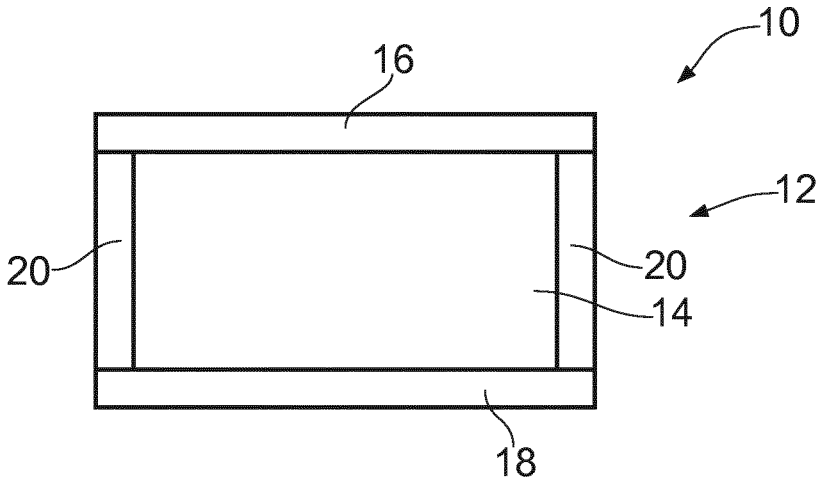
FIG. 2 illustrates an example apparatus.

FIG. 2 illustrates an example of the disclosure in which the first and second electrical contacts 16, 18 are separated by an insulating material 20. The first and second electrical contacts 16, 18 may be spaced apart by the insulating material 20. The insulating material 20 is configured to prevent the flow of electric current directly between the first and second electrical contacts 16, 18. The direct current connection provided by the resistive material 14 may bypass the insulating material 20.

The insulating material 20 may be arranged to guide the flow of electric current between the first and second electrical contacts 16, 18 through the resistive material 14.

Figure 3:
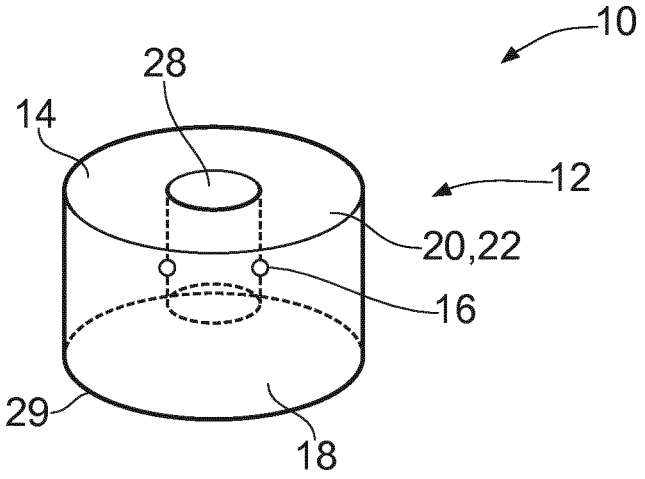
FIG. 3 illustrates another example apparatus in perspective view.
Figure 4:
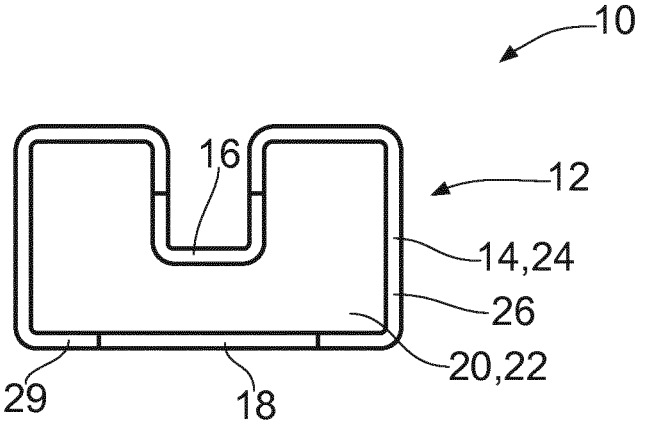
FIG. 4 illustrates the example apparatus of FIG. 3 in cross section.

FIGS. 3 and 4 illustrate an example of the disclosure in which the connector 12 comprises a body 22, the body 22 comprising the insulating material 20. A layer 24 of the resistive material 14 is provided on at least a part of the external surface 26 of the body 22.

Figure 5:
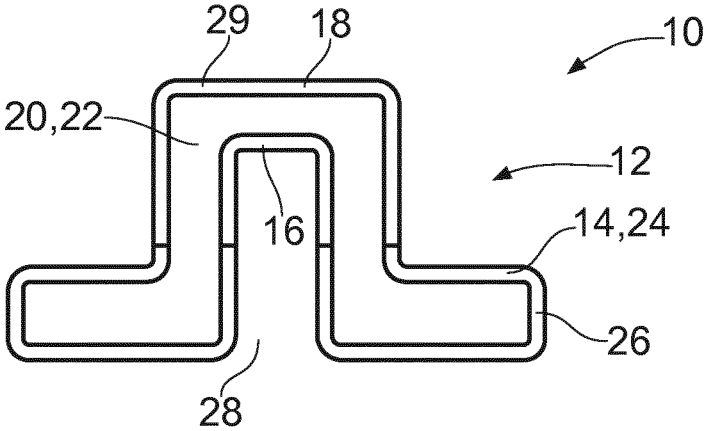
FIG. 5 illustrates another example apparatus in cross section.

FIG. 5 illustrates a further example of the disclosure in which the connector 10 also comprises a body 22, the body 22 comprising the insulating material 20. A layer 24 of the resistive material 14 is provided on at least a part of the external surface 26 of the body 22.

The body 22 may be formed of the insulating material 20. The insulating material 20 may be a ceramic material, for example, the insulating material may be alumina, $Al_2O_3$. In examples in which the apparatus 10 comprises a body 22 formed of a ceramic material, the body may be provided by ceramic injection moulding.

In the example illustrated in FIGS. 3 and 4 and the further example illustrated in FIG. 5, the connector 12 comprises an opening 28 extending part way into the body 22. A first of the electrical contacts 16 is provided in the opening 28, and a second of the electrical contacts 18 is provided on an opposite side 29 of the connector 12 to the opening 28.

The connector 12 may comprise a protective coating overlaying the layer 24 of resistive material 14, or may comprise a protective coating overlaying at least a part of the external surface 26. The protective coating may not overlay the electrical contacts 16, 18.

In some examples, the layer 24 of resistive material 14 may be a thin film resistor. The thin film resistor may have a thickness of around 0.1 microns. The layer 24 of resistive material 14 may comprise a metallic layer. The material of the thin film resistor may comprise an alloy of Nickel and Chromium.

In other examples, the layer 24 of resistive material 14 may be a thick film resistor. The thick film resistor may have a thickness of around 100 microns. The material of the thick film resistor may comprise a mixture comprising a binder, a carrier, and metal oxides. The binder may comprise a glassy frit and the carrier may comprise organic solvent, and may comprise plasticisers. The metal oxides may comprise ruthenium, iridium and rhenium.

In the example illustrated in FIGS. 3 and 4 and the further example illustrated in FIG. 5, the connector 12 provides a snap connector. In the example illustrated in FIGS. 3 and 4, the connector 12 provides a female snap connector. In the example illustrated in FIG. 5, the connector 12 provides a male snap connector.

The connector 12 illustrated in FIGS. 3 to 5 may be formed as follows. In a first step, the body 22 is formed by ceramic injection moulding. The layer 24 of the resistive material 14 is provided on at least a part of the external surface 26 of the body 22. The first and second electrical contacts 16, 18 are then provided on the body 22. The process of ceramic injection moulding may involve the steps of providing a homogeneous mixture of ceramic powder and polymer, providing a moulded intermediate by injection moulding, thermal removal of the polymer by debinding, and sintering to form the body 22.

Figure 6:
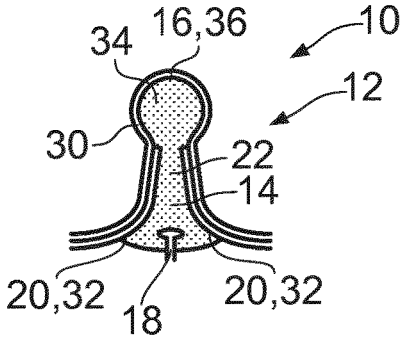
FIG. 6 illustrates another example apparatus in cross section.

FIG. 6 illustrates an example of the disclosure in which the connector 12 comprises a body 22, the body 22 comprising the resistive material 14, wherein the body 22 comprises a conductive shell 30. A layer 32 of the insulating material 20 is provided between at least a part of the conductive shell 30 and the resistive material 14. The conductive shell 30 may comprise metal.

In the example illustrated in FIG. 6, the first electrical contact 16 is provided by the conductive shell 30, and the second electrical contact 18 extends from the resistive material 14. The layer 32 of insulating material 20 is arranged to guide the flow of electric current between the first and second electrical contacts 16, 18 through the resistive material 14.

The resistive material 14 may substantially fill an area 34 defined by the conductive shell 30. The resistive material 14 may comprise carbon composition, which may comprise a mixture of carbon and insulating material. The insulating material 20 may be a non-conducting adhesive.

In the example illustrated in FIG. 6, the connector 12 provides a snap connector. In particular, the connector 12 provides a male snap connector. In other examples, the connector 12 may provide a female snap connector.

In examples in which the connector 12 provides a male snap connector, the first electrical contact 16 is provided by an end portion 36 of the connector 12.

Figures 7A, 7B, 7C, 7D, 7E:
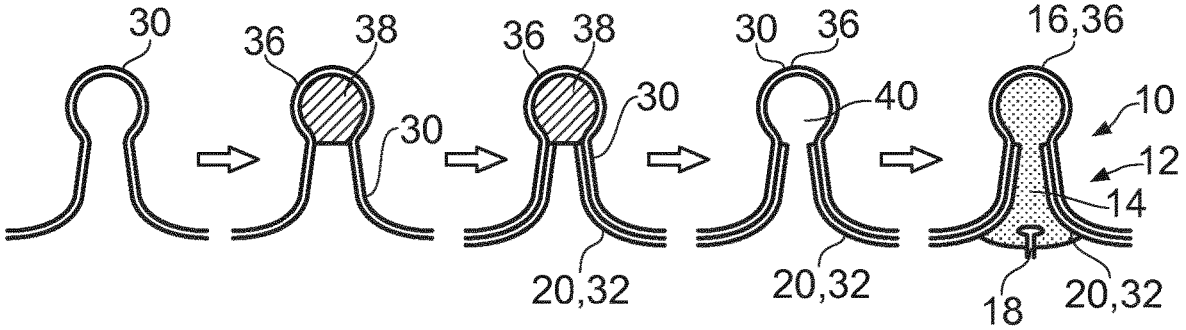
FIG. 7 illustrates an example process for forming the apparatus of FIG. 6.

FIGS. 7A to 7E illustrate an example process for forming the apparatus 10 illustrated in FIG. 6. In FIG. 7A a conductive shell 30 is provided. In the example illustrated a conductive shell 30 in the form of a male snap connector 12 is provided. In other examples, a conductive shell 30 in the form of a female snap connector 12 may be provided. In 7B, a mask 38 is provided in the end portion 36 of the connector 12. In 7C, a layer 32 of the insulating material 20 is provided on the inner surface 40 of the conductive shell 30. The mask 38 prevents a layer 32 of insulating material 20 being provided on the inner surface 40 of the end portion 36 of the conductive shell 30. In 7D, the mask 38 is removed. In step 7E, resistive material 14 is provided within the conductive shell 30. The resistive material 14 contacts the inner surface 40 of the conductive shell 30 only in the end portion 36 of the connector 12, which had been protected by the mask 38. Accordingly, the layer 32 of insulating material 20 is provided between at least a part of the conductive shell 30 and the resistive material 14. Accordingly, the layer 32 of the insulating material 20 is not provided between the conductive shell 30 and the resistive material 14 in the end portion 36 of the connector 12.

Figure 8:
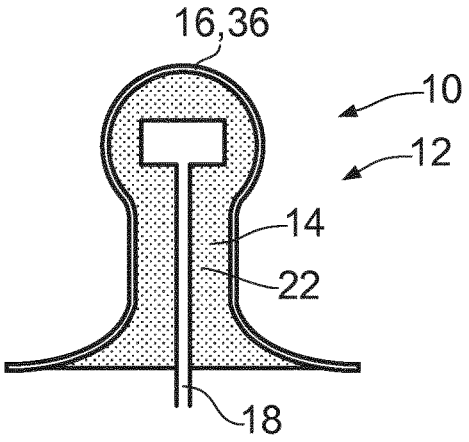
FIG. 8 illustrates another example apparatus in cross section.

FIG. 8 illustrates an example of the disclosure in which the connector 12 of the apparatus 10 comprises a body 22, the body 22 comprising the resistive material 14. The body 22 may be formed of the resistive material 14. The resistive material 14 may be conductive plastic. The conductive plastic may comprise carbon black, or any other electrically conductive filler.

In the example illustrated in FIG. 8, the connector 12 provides a snap connector. In particular, the connector 12 provides a male snap connector. In examples in which the connector 12 provides a male snap connector, the first electrical contact 16 is provided by an end portion 36 of the connector 12. In examples where the resistive material 14 comprises conductive plastic, the first electrical contact 16 is provided by the conductive plastic in the end portion 36 of the connector 12. The second electrical contact 18 extends from the resistive material 14. In the example illustrated in FIG. 8, the second electrical contact 18 extends from the end portion 36 of the connector 12 through the resistive material 14. In the example illustrated in FIG. 8, the second electrical contact 18 is a metal contact.

Figure 9:
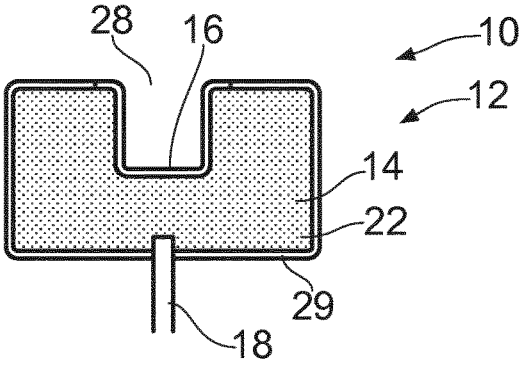
FIG. 9 illustrates another example apparatus in cross section.

FIG. 9 also illustrates an example of the disclosure in which the connector 12 comprises a body 22, the body 22 comprising the resistive material 14. The body 22 may be formed of the resistive material 14. The resistive material may be conductive plastic. In the example illustrated in FIG. 9, the connector 12 provides a female snap connector. A first of the electrical contacts 16 is provided in an opening 28, and a second of the electrical contacts 18 is provided on an opposite side 29 of the connector 12 to the opening 28. The second electrical contact 18 extends from the resistive material 14. In the example illustrated in FIG. 9, the first and second electrical contacts 16, 18 are metal contacts.

Figure 10:
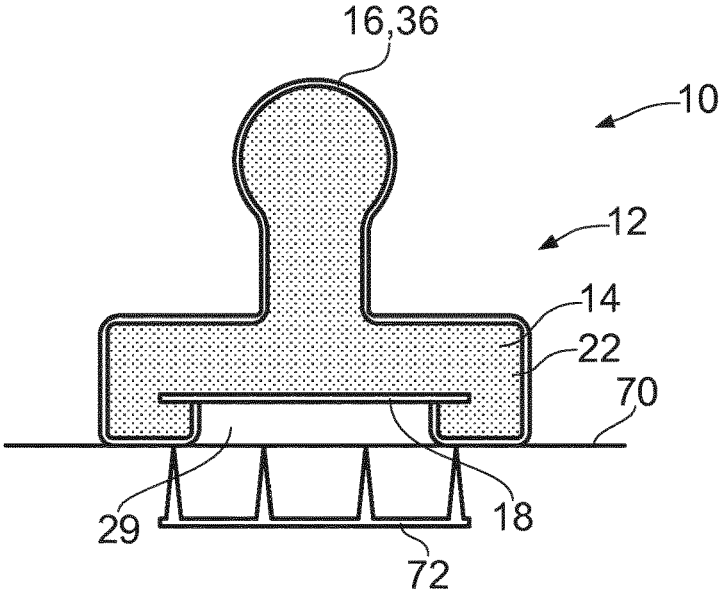
FIG. 10 illustrates another example apparatus in cross section

FIG. 10 also illustrates a male snap connector of the type comprising a body 22, wherein the body 22 comprises the resistive material 14, as per the examples of FIGS. 8 and 9. In the example illustrated in FIG. 10, the connector 12 is in the process of being attached to a belt 70, for instance a chest belt 70. In the example illustrated in FIG. 10, the first electrical contact 16 is provided by the conductive plastic in the end portion 36 of the connector 12. The second electrical contact 18 is a metal plate located on an opposite side 29 of the connector 12 to the first contact 16. The connector 12 is connected to the belt 70 by a metal crimp part 72 which is configured to extend through the belt 70 to contact the second electrical contact 18.

In examples of the disclosure where the body 22 is formed of a conductive plastic, the body 22 may be moulded from the conductive plastic. The body 22 may be formed by injection moulding from the conductive plastic.

Figure 11:
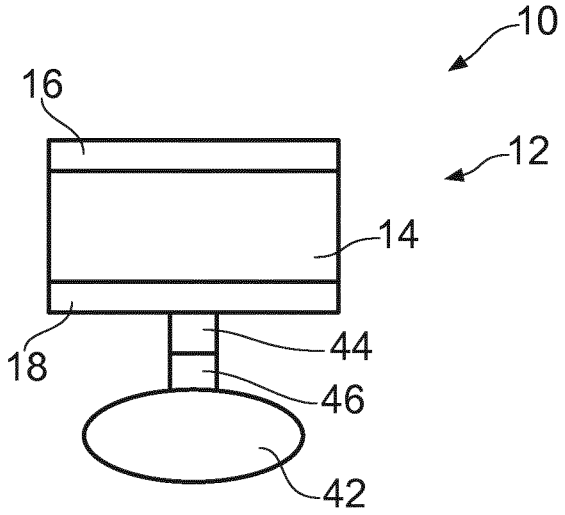
FIG. 11 illustrates an apparatus in use.

In some examples of the disclosure, for instance the example illustrated in FIG. 11, the connector 12 of the apparatus 10 is configured to be electrically and mechanically connectable to an electrode 42. The electrode 42 is therefore the electrical terminal. The connector 12 may be connectable to the electrode by a friction fit, which may be an interference fit.

The connector 12 comprises a formation 44 shaped to mate with a corresponding formation 46 on the electrode 42 to electrically and mechanically connect to the electrode.

Figure 12:
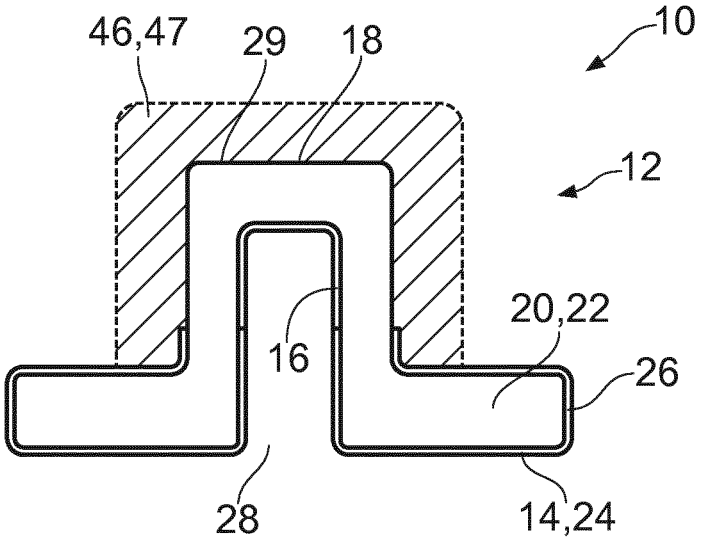
FIG. 12 illustrates the apparatus of FIG. 5 in use.

The formation 44 may be shaped to receive the corresponding formation 46 on the electrode 42 to electrically and mechanically connect to the electrode 42. The connector 12 may provide a snap connector, and may comprise a female snap connector, such as the examples in FIGS. 3, 4 and 9. The formation may therefore comprise an opening 28 to receive a corresponding male part of a male snap connector provided by the formation 46 of the electrode 42. In other examples, such as illustrated in FIG. 12, the connector 12 may comprise a male snap connector, such as the examples in FIGS. 5, 6 and 8, configured to mate with a corresponding female part of a female snap connector 47 provided by the formation 46 of the electrode 42. The example of FIG. 12 illustrates the apparatus 10 of FIG. 5 in use.

Figure 13:
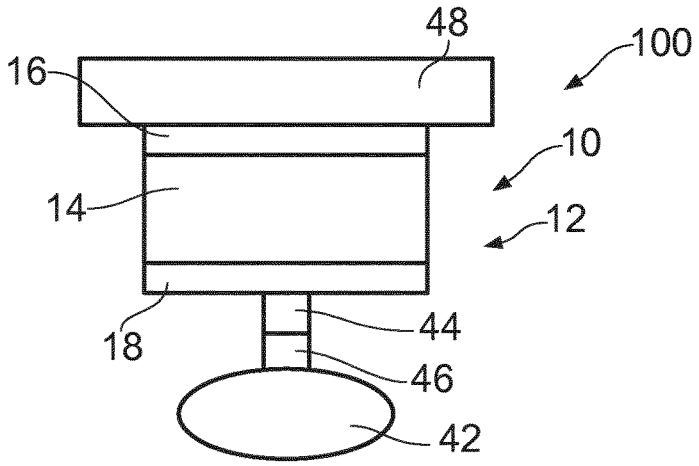
FIG. 13 illustrates a system comprising an apparatus.

Examples of the disclosure also provide a system 100 as illustrated in FIG. 13 comprising an electronic device 48, the electronic device 48 comprising the apparatus 10 according to examples of the disclosure.

Figure 14:
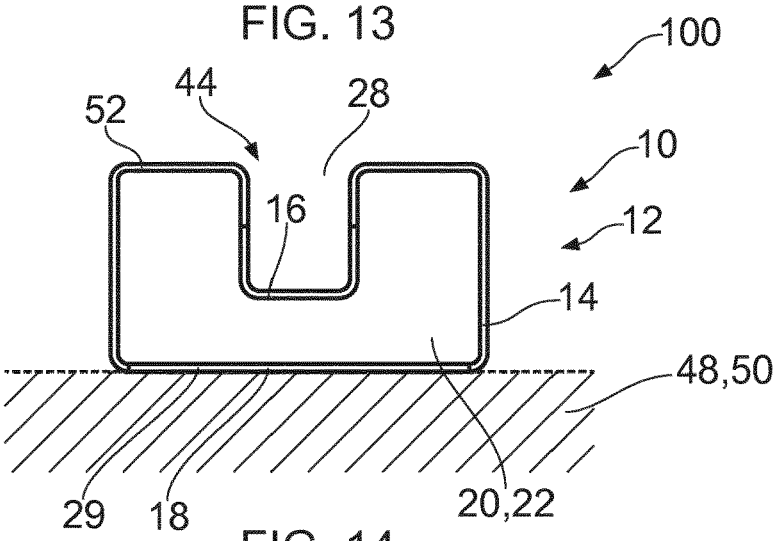
FIG. 14 illustrates the system of FIG. 13.

As illustrated in FIG. 14, the side 29 of the connector 12 of the apparatus 10 may be joined to the electronic device 48. In some examples, the side 29 of the connector 12 of the apparatus 10 is joined to the electronic device 48 by soldering, and may be joined to the electronic device 48 by soldering to a printed circuit board 50 of the electronic device 48. FIG. 14 illustrates the example of FIG. 4 in use.

A second side 52 of the connector 12 may comprise the formation 44 shaped to mate with a corresponding formation 46 on an electrode 42 to electrically and mechanically connect to the electrode 42. The formation 44 may be shaped to receive the corresponding formation 46 on the electrode 42 to electrically and mechanically connect to the electrode 42. The connector 12 may provide a snap connector, and may comprise a female snap connector, as illustrated in FIG. 14. The formation may therefore comprise an opening 28 shaped to receive a corresponding male part of a male snap connector provided by the formation 46 of the electrode 42.

Figure 15:
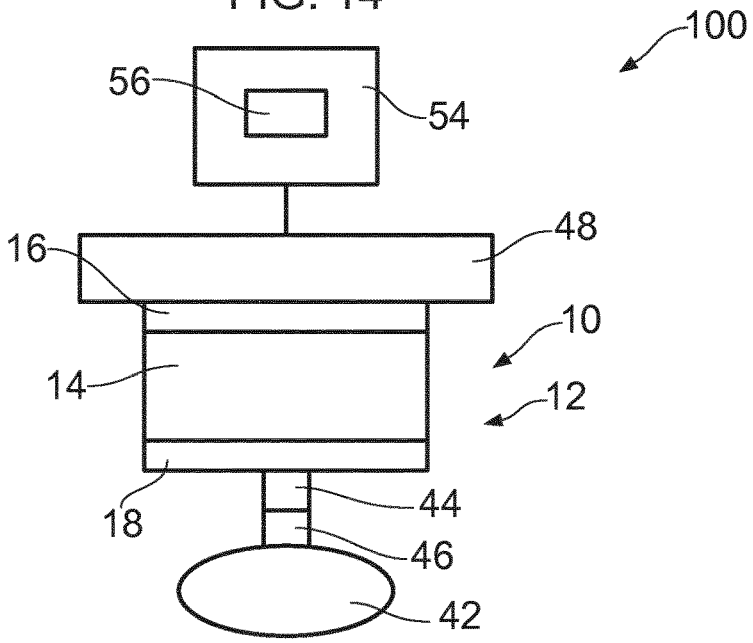
FIG. 15 illustrates a further system comprising an apparatus.

As illustrated in FIG. 15, the electronic device may comprise monitoring circuitry 54, such as ECG monitoring circuitry 54. The monitoring circuitry 54 may comprise an amplifier 56. ECG measures the electrical activity of the heart over a period of time.

Figure 16:
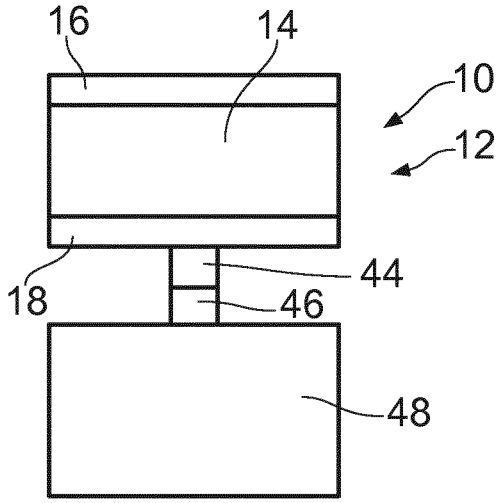
FIG. 16 illustrates an apparatus in use.

In other examples of the disclosure, for instance the example illustrated in FIG. 16, the connector 12 of the apparatus 10 is configured to be electrically and mechanically connectable to an electronic device 48. The electronic device 48 is therefore the electrical terminal. The connector 12 may be connectable to the electronic device 48 by a friction fit, which may be an interference fit.

The connector 12 comprises a formation 44 shaped to mate with a corresponding formation 46 on the electronic device 48 to electrically and mechanically connect to the electronic device 48.

The formation 44 may be shaped to receive the corresponding formation 46 on the electronic device 48 to electrically and mechanically connect to the electronic device 48. The connector 12 may provide a snap connector, and may comprise a male snap connector, such as the examples in FIGS. 5, 6 and 8. The corresponding formation 46 on the electronic device 48 may comprise a snap connector, and may comprise a female snap connector.

Figure 17:
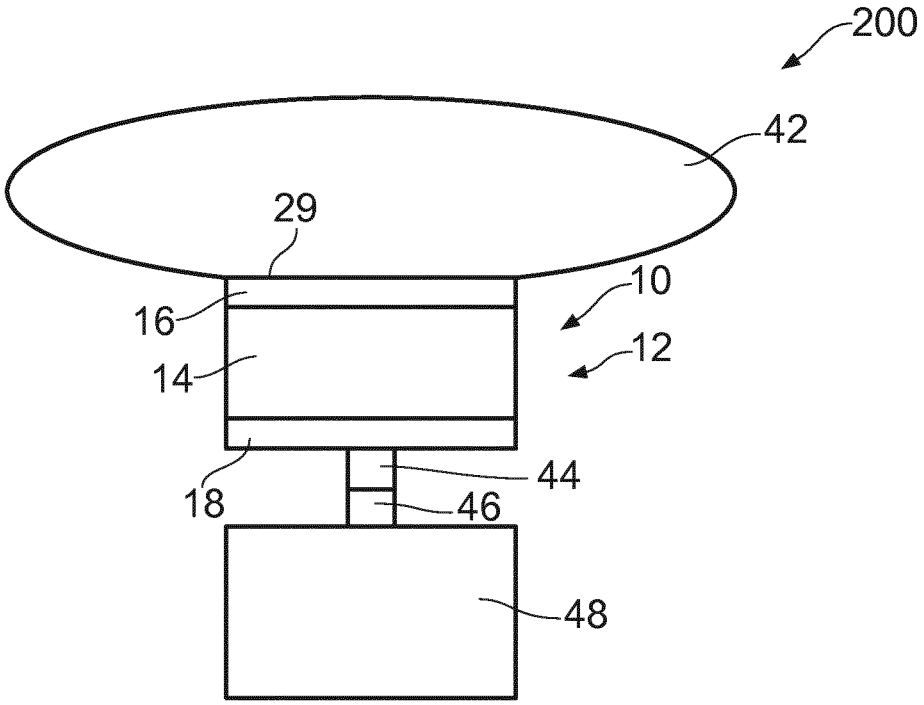
FIG. 17 illustrates a further system comprising an apparatus.

Examples of the disclosure also provide a system 200 as illustrated in FIG. 17 comprising an electrode 42, the electrode 42 comprising the apparatus 10 according to examples of the disclosure. The side 29 of the connector 12 of the apparatus 10 is joined to the electrode 42. In some examples, the side 29 of the connector 12 of the apparatus 10 is joined to the electrode 42 by soldering.

A second side 52 of the connector 12 may comprise the formation 44 shaped to mate with a corresponding formation 46 on electronic device 48 to electrically and mechanically connect to the electronic device 48. The formation 44 may be shaped to receive the corresponding formation 46 on the electronic device 48 to electrically and mechanically connect to the electronic device 48. The connector 12 may provide a snap connector, and may comprise a male or female snap connector.

Accordingly, the connector 12 of the apparatus 10 according to examples of the disclosure could be a male or female snap connector, and could be configured to be electrically and mechanically connectable to an electrode or an electronic device. Respective male and female snap connectors may be connectable by a friction fit, which may be an interference fit.

Figure 18:
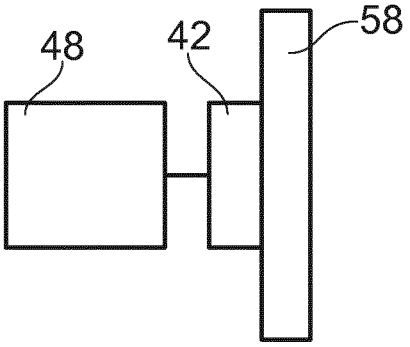
FIG. 18 illustrates a further system in use.

As illustrated in FIG. 18, the electronic device 48 may be configured to monitor a body function of a subject, such as a health parameter of a subject 58. The electrode 42 may be configured to be engageable with the subject 58, for instance to be engageable with the skin of the subject 58, to make an electrical circuit with the electronic device 48 to allow detection of the health parameter. In the case of ECG, the health parameter is the electrical activity of the heart over a period of time.

In some examples the electronic device 48 is attachable to an item wearable by a subject. The item may comprise a strap, belt or band, and may comprise a chest strap, belt or band. The electronic device 48 may be removable from the item.

Figure 19:
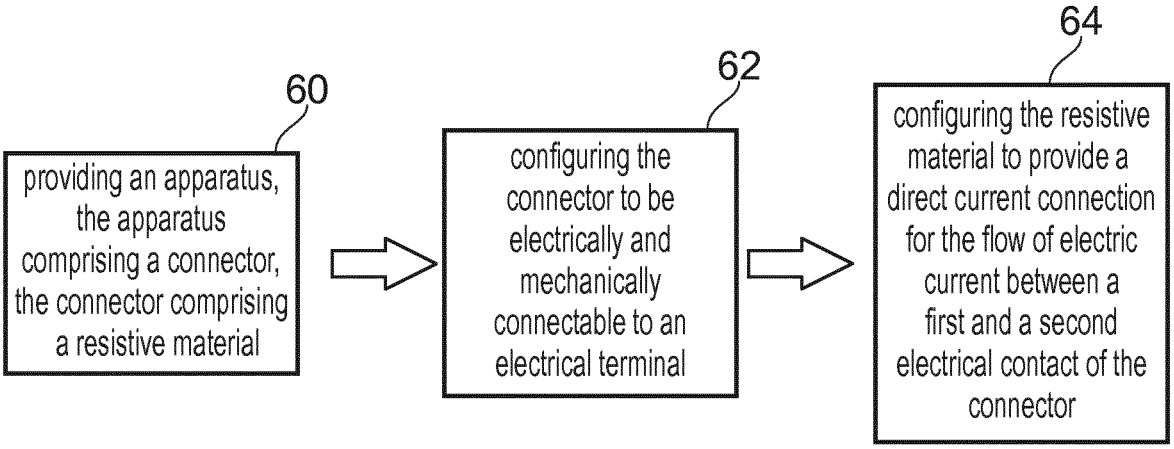
FIG. 19 illustrates a method.

FIG. 19 illustrates a method according to examples of the disclosure of manufacturing and apparatus 10. At block 60 the method comprises providing an apparatus 10, the apparatus 10 comprising a connector 12, the connector 12 comprising a resistive material 14. At block 62, the method comprises configuring the connector 12 to be electrically and mechanically connectable to an electrical terminal. At block 64, the method comprises configuring the resistive material 14 to provide a direct current connection for the flow of electric current between a first and a second electrical contact 16, 18 of the connector 12.

The method may comprise any of the steps described in any of the preceding statements or description.

The figures also provide a method of manufacturing the system 100. The method may comprise any of the steps described in any of the preceding statements or description.

Figure 20:
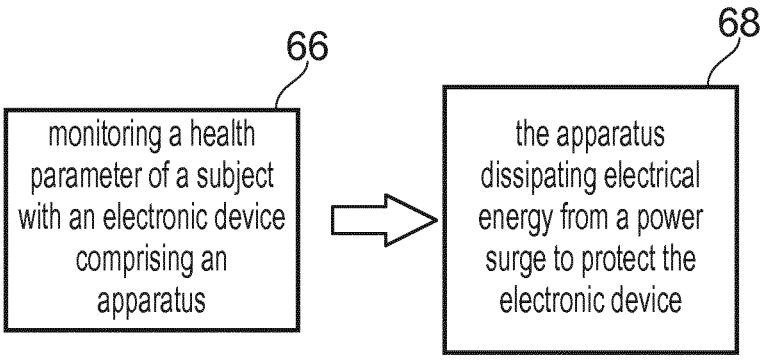
FIG. 20 illustrates another method.

FIG. 20 illustrates a method according to examples of the disclosure for protecting an electronic device from a power surge.

At block 66, the method comprises monitoring a health parameter of a subject with an electronic device comprising an apparatus according to examples of the disclosure. At block 68, the method comprises the apparatus dissipating electrical energy from a power surge to protect the electronic device.

The electronic device 48 may be wearable electronic device 48. The health parameter may be the electrical activity of the heart.

The electronic device 48 may be attachable to the item wearable by a subject. The item may comprise a strap, belt or band, and may comprise a chest strap, belt or band. The electronic device 48 may be removable from the item.

In examples of the disclosure in which a health parameter of a subject is monitored with an electronic device 48 comprising an apparatus 10 according to examples of the disclosure, the data collected by the device 48 may be stored in a computer, mobile device, cloud service or other network element. The data may be for instance the electrical activity of the user's heart over a period of time. Accordingly, examples of the disclosure may form part of an interconnection of electronic devices via the Internet, wherein the internet enables the electronic devices to send and receive such data.

There is thus described an apparatus, system and method with a number of advantages as detailed above and as follows.

As noted above, resistors capable of dissipating energy are used to protect electronic devices from electrical power surges. For instance, resistors are used to protect devices comprising ECG monitoring circuitry from electrical power surges caused by a high-voltage pulse from a defibrillator shock and subsequent electrical coupling of the signal through the body of the patient to the ECG electrodes.

Examples of the disclosure provide a means of protecting electronic devices, such as wearable devices configured to measure a body function of a patient such as a health parameter, from such electrical power surges. Examples according to the disclosure provide a connector 12 configured to be electrically and mechanically connectable to an electrical terminal, wherein the connector 12 comprises a resistive material 14. In the case where the electrical terminal is, for instance, a wearable electronic device or an electrode forming part of an ECG system, examples according to the disclosure provide means of incorporating a resistor into such electrical systems by incorporating the resistor, i.e. the resistive material, into the connectors, such as snap connectors.

In examples of the disclosure comprising a thin film resistor, such a thin film resistor may be configured to provide a small temperature coefficient of resistance, and long term stability. In examples of the disclosure comprising a thick film resistor, such a thick film resistor may be configured to provide a wide range of resistance values and to withstand high surge conditions.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that comprise some but not all of the instances in the class. It is therefore implicitly disclosed that a features described with reference to one example but not with reference to another example, can where possible be used in that other example but does not necessarily have to be used in that other example.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising: a connector configured to be electrically and mechanically connectable to an electrical terminal, wherein the connector comprises a resistive material, wherein the connector comprises respective first and second electrical contacts, wherein the resistive material is configured to provide a direct current connection for the flow of electric current between the first and second electrical contacts, wherein the first and second electrical contacts are separated by an insulating material, and wherein the connector comprises a body, the body comprising the insulating material, wherein a layer of the resistive material is provided on at least a part of the external surface of the body, the insulating material being arranged to guide the flow of electric current between the first and second electrical contacts through the resistive material.

2. The apparatus according to claim 1, wherein the connector comprises a snap connector.

3. The apparatus according to claim 1, wherein the body is formed of the insulating material.

4. The apparatus according to claim 3, wherein the insulating material is ceramic material.

5. The apparatus according to claim 1, wherein the layer of resistive material is a thin film resistor.

6. The apparatus according to claim 1, wherein the connector comprises a body, the body comprising the resistive material.

7. The apparatus according to claim 6, wherein the body comprises a conductive shell, wherein a layer of the insulating material is provided between at least a part of the conductive shell and the resistive material.

8. The apparatus according to claim 7, wherein the conductive shell comprises metal.

9. The apparatus according to claim 7, wherein the resistive material comprises carbon composition.

10. The apparatus according to claim 6, wherein the body is formed of the resistive material.

11. The apparatus according to claim 10, wherein the resistive material comprises conductive plastic.

12. The apparatus according to claim 1, wherein the connector comprises a formation shaped to mate with a corresponding formation on an electrode to electrically and mechanically connect to the electrode.

13. A system comprising an electronic device, the electronic device comprising the apparatus comprising a connector configured to be electrically and mechanically connectable to an electrical terminal, wherein the connector comprises a resistive material, wherein the connector comprises respective first and second electrical contacts, wherein the resistive material is configured to provide a direct current connection for the flow of electric current between the first and second electrical contacts, wherein the first and second electrical contacts are separated by an insulating material, and wherein the connector comprises a body, and the body comprising the insulating material, wherein a layer of the resistive material is provided on at least a part of the external surface of the body, the insulating material being arranged to guide the flow of electric current between the first and second electrical contacts through the resistive material.

14. The system according to claim 13, wherein the electronic device is a wearable electronic device.

15. The system according to claim 14, wherein the electronic device is configured to monitor a body function of a subject.

* * * * *